US006998968B2

(12) United States Patent
Garnault et al.

(10) Patent No.: US 6,998,968 B2
(45) Date of Patent: Feb. 14, 2006

(54) MOTOR VEHICLE DOOR HANDLE

(75) Inventors: Joël Garnault, Sannois (FR); Ciprian Musat, Creteil (FR); Jean-Claude Huth, Antony (FR)

(73) Assignee: Valeo Electronique, Creteil (FR)

( * ) Notice: Subject to any disclaimer, the term of this patent is extended or adjusted under 35 U.S.C. 154(b) by 65 days.

(21) Appl. No.: 10/484,470

(22) PCT Filed: Jul. 31, 2002

(86) PCT No.: PCT/EP02/08539

§ 371 (c)(1),
(2), (4) Date: Jan. 22, 2004

(87) PCT Pub. No.: WO03/012230

PCT Pub. Date: Feb. 13, 2003

(65) Prior Publication Data

US 2004/0217601 A1 Nov. 4, 2004

(30) Foreign Application Priority Data

Aug. 1, 2001 (FR) ..... 01 10614
Sep. 7, 2001 (FR) ..... 01 11820

(51) Int. Cl.
*G60R 25/10* (2006.01)

(52) U.S. Cl. ..... 340/426.28; 340/542

(58) Field of Classification Search ..... 340/426.28, 340/561, 562, 542, 539.23; 307/9.1, 10.1
See application file for complete search history.

(56) References Cited

U.S. PATENT DOCUMENTS

| | | | | |
|---|---|---|---|---|
| 6,075,294 | A | 6/2000 | Van den Boom et al. | |
| 6,218,933 | B1 * | 4/2001 | Josserand et al. | 340/426.28 |
| 6,367,295 | B1 * | 4/2002 | Agostini et al. | 70/257 |
| 6,459,373 | B1 * | 10/2002 | Edwards | 340/547 |
| 6,518,883 | B1 * | 2/2003 | Benard et al. | 340/542 |
| 6,527,316 | B1 * | 3/2003 | Agostini et al. | 292/347 |
| 6,768,413 | B1 * | 7/2004 | Kemmann et al. | 340/5.72 |
| 6,774,789 | B1 * | 8/2004 | Inaba et al. | 340/541 |
| 6,847,289 | B1 * | 1/2005 | Pang et al. | 340/426.28 |
| 6,883,840 | B1 * | 4/2005 | Sueyoshi et al. | 292/336.3 |

FOREIGN PATENT DOCUMENTS

WO WO 01/40606 A1 6/2001

* cited by examiner

*Primary Examiner*—John Tweel, Jr.
(74) *Attorney, Agent, or Firm*—Berenato, White & Stavish

(57) ABSTRACT

The disclosure relates to a door handle, in particular for a motor vehicle, comprising at least one presence sensor having at least one electrode for detecting the presence of a user at said handle, wherein it comprises conducting means having at least one proximal end directly or indirectly connected by capacitive coupling to said detection electrode and at least one distal end emerging in electrical insulation on the outer surface of the handle so as to create at least one new zone for detecting the presence of a user. The invention also relates to a hands-free access system for a motor vehicle comprising such a door handle.

29 Claims, 6 Drawing Sheets

MOTOR VEHICLE DOOR HANDLE

BACKGROUND OF THE INVENTION

1. Field of the Invention

The invention relates to a door handle notably for a motor vehicle, and more particularly a door handle incorporating at least one presence sensor to detect the presence of a user at the handle.

The invention also relates to a hands-free access system for a motor vehicle including such a handle.

2. Description of the Related Art

In the early days of the automobile, the door handle served only to transmit mechanical movements via tie-rods to a door-catch to open the door. Today the door handle has undergone great changes.

In particular, in so-called "hands-free" systems enabling locking and unlocking of a motor vehicle without a mechanical key or remote control, the handle has become a special interface between the user, wearing an identifier in the form of a badge, for example, and the vehicle's onboard system.

A handle as used in a "hands-free" system is shown in FIG. 1.

Generally, such a handle 1 comprises two parts, a grasping part 2 that is mobile relative to the door 4 of the vehicle and a fixed part 3 that is essentially decorative or houses, for example, a backup lock. Both the mobile part 2 and the fixed part 3 are made of plastic material.

As seen in FIG. 1, the mobile part has an internal cavity 6 serving as a housing for a support module 7. To enable the module to be fitted in the handle the internal cavity 6 (hereinafter referred to as the "housing") is open on one side in a zone located opposite the fixed part 3. The housing 6 is closed by a plugging part 6*bis*.

The support module 7 includes presence sensors and notably an approach sensor 9 and a tactile sensor 8.

The approach sensor 9 is used to initiate the communication between the identifier and the vehicle's onboard system when the user approaches the vehicle, whereas the tactile sensor 8 is used to detect a voluntary action by the user to lock the vehicle.

As shown in FIG. 1, the approach detection zone 12 associated with the approach sensor 9 is situated between the door 4 and the grasping part 2 of the handle.

The approach sensor 9 is for example a capacitive sensor that operates by measuring the variation of the electromagnetic field surrounding it. It has at least one detection electrode 10 whose shape enables an extended and well-defined detection zone between the door 4 and the grasping part of the handle 2.

The tactile sensor 8 is also a capacitive sensor, for example. It has a detection electrode 10 which enables detection over a precisely defined zone 11 located at the outer surface of the handle. This tactile detection 11 zone has high sensitivity to a touching action.

Such an arrangement of the various parts in the handle has the disadvantage of offering very limited freedom for positioning the various sensors on the support module owing to the small size of the housing 6, imposed by mechanical constraints. The result is that the location of the various detection zones is practically imposed by the geometry of the handle and its housing.

Consequently, these various detection zones may find themselves located in relatively inaccessible places or may present major usability problems. Furthermore, such an arrangement does not enable the use of standard handles usable by both left-handed and right-handed users, since this implies being able to choose the position of the various detection zones such that they are quite distinct and easily accessible to the user.

Moreover, it has been observed, later, that when such handles are painted, metal-plated or even solid metal, the operation of the presence sensors is highly perturbed.

In effect, a conductive coating, which can be a chemical deposit such as chrome-plating, paint, a primer for decorative coatings or even the material constituting the handle, causes modification of the capacitive couplings between the detection electrodes of the various sensors and the surface of the handle.

This perturbation mainly associated with the electrical conductivity of the coating results in a change of the shape of the presence detection zones covered by the various presence sensors and consequently lowers sensitivity of the sensor.

In the case of the approach sensor, spreading of the detection zone is observed, accompanied by a substantial reduction in the detection distance from the handle. Remote detection (i.e. at a distance of a few centimeters) of an approaching user is no longer possible: the user must be within one centimeter—or even in contact with the handle—for the detection to be made. The reason is that the conductive coating constitutes a screen for the electric field lines of the approach sensor, which greatly reduces the ability to detect presence by measuring electrical capacitance.

In the case of the tactile sensor, spreading of the tactile detection zone over a large part of the handle surface is usually observed, with a consequent large drop in sensitivity of the sensor and total loss of the tactile detection function.

To illustrate this problem better, FIG. 2 shows schematically the sensitivity S of a tactile sensor 8 relative to the width of the electrode 10, in one dimension only.

The solid curve A shows the sensitivity curve of the tactile sensor for a handle made of electrically insulating material. This curve A has a flat section P whose width E corresponds substantially to the width of the electrode 10. It is seen that the sensitivity drops off strongly on each side.

The dashed curve B shows the sensitivity of the tactile sensor for a handle with a conductive surface coating. This sensitivity curve is broader and its maximum height is much less than curve A, which implies malfunctions of the sensor 8; moreover, this curve has no characteristic plateau, which signifies that the detection zone is spread and not very well defined, which is a serious handicap in terms of usability.

As stated previously, the presence of this conductive coating perturbs the tactile sensor due to the spreading of the tactile detection zone over a larger surface of the handle, resulting in serious loss of sensitivity of the sensor. The tactile detection is therefore strongly perturbed.

The lack of flexibility in the positioning of the detection zones of the approach and tactile sensors plus, in the case of painted or metal-plated handles, the modification of these zones and the resulting weak detection are particularly problematic.

SUMMARY OF THE INVENTION

The invention aims to overcome these disadvantages and propose a solution for creating a new presence detection zone that is easily accessible, ergonomic and compatible with a conductive handle or a handle with a conductive surface coating, such that approach or tactile detection is assured.

The solution proposed consists in adding conducting means between the detection electrode of the presence sensor and the location at the handle surface where this new detection zone is to be created. In the case of a perturbing conductive coating, these conducting means are preferentially more conductive than this coating.

In the case of an approach sensor, the detection distance is increased to create a new detection zone that is better controlled, by directing the electric field lines generated by the sensor inside the handle to slots at the surface of the handle.

In the case of a tactile sensor, the initial detection zone of the tactile sensor is then shifted by capacitive coupling and electrical conduction phenomena to the place where this new detection zone is to be created.

In this manner, it is possible to create a new approach or tactile presence detection zones at the outer surface of the handle arid to ensure normal operation of the whole "hands-free" system even when the surface of the handle is conductive. These new presence detection zones can be located close to the conductive coating but must be isolated from it by insulating means.

To this end, the object of the invention is a door handle, in particular for a motor vehicle, comprising at least one presence sensor having at least one electrode for detecting the presence of a user at said handle, wherein it comprises conducting means having at least one proximal end directly or indirectly connected by capacitive coupling to said detection electrode and at least one distal end emerging in electrical insulation on the outer surface of the handle so as to create at least one new zone for detecting the presence of a user.

The door handle according to the invention can also include one or more of the following characteristics:

the door handle has a grasping part with an inner housing, formed by an elongated cavity in this grasping part, that houses said presence sensor, said presence sensor has at least two electrodes and, for each electrode, said conducting means have an associated proximal end that positions near this electrode, said proximal end of said conducting means is formed by a metal blade positioned near said electrode and of which at least one part is approximately parallel to it, said conducting means are formed by a single metal blade, said presence sensor is carried by a support module that is inserted in said housing, said metal blade takes the form of a spring positioning and/or holding said support module in said housing, said metal blade is fixed on said support module or on said presence sensor, said handle also has at least one opening emerging on the outer surface of the handle and said distal end of said conducting means is flush with this outer surface, said conducting means have a number of distal ends flush with the outer surface of the handle at the positions of the associated openings, said openings are aligned parallel to a longitudinal axis of the grasping part of the handle, said conducting means are held in said opening by fastening means also serving as electrical insulator, said fastening means are formed by a glue or clipping means in plastic material, said conducting means are overmoulded with an insulating material, said insulating material forms the plugging means for said openings, said conducting means have an intermediate part constituted by plugging means (18) of said housing (6) of said presence sensor, said metal blade is fixed to and/or formed from the material of said plugging means, said distal end of the conducting means include a movable part, said movable part is a lock cache, notably of a backup lock, said distal end forms a conductive part of a handle part (3) fixed relative to the door, and said presence sensor is housed in a mobile grasping part of the handle, the handle is made from a plastic material, the outer surface of the handle is covered with a conductive coating, said conducting means having a number of distal ends flush with the outer surface of the handle at the positions of the associated openings, said conductive coating is a metalized paint or a direct metalization, the handle is made from metal and also includes electrical insulation means forming a sheath for said conducting means, said presence sensor is an approach sensor to detect the approach of a user near the handle, said presence sensor is a tactile sensor to detect a user touching the handle, the new detection zone of said tactile sensor is delimited by the shape of said distal end of said conducting means, said presence sensor is a sensor of capacitive type.

Another object of the invention is a hands-free access system for a motor vehicle including such a door handle.

BRIEF DESCRIPTION OF THE DRAWINGS

The invention will be better understood on reading the detailed description below of embodiments, which are non-limitative and taken only as examples, with reference to the attached drawings of which.

DETAILED DESCRIPTION OF THE PREFERRED EMBODIMENTS

Figure 3:
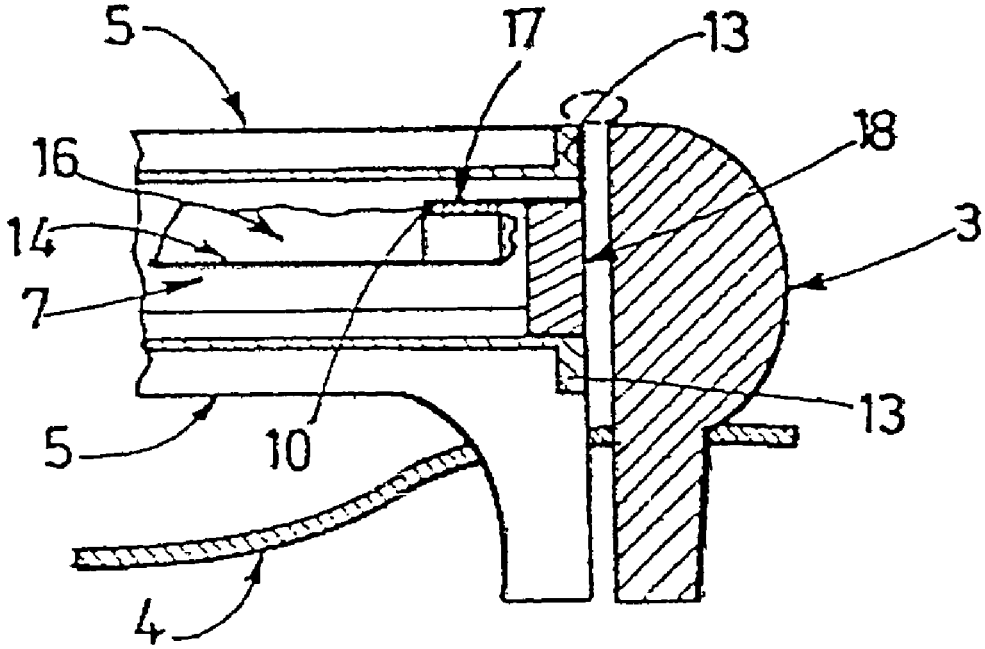
FIG. 3 is a partial sectional view of the handle in which the proximal end of the conducting means takes the form of a metal blade.

FIG. 3 is a partial sectional view of a first embodiment of a handle according to the invention. In this figure the items identical to those of FIG. 1 carry the same reference numbers.

The handle 1 has at the outer surface of its grasping part 2 a conductive surface 5 formed by a coating, such as paint, or a conductive film made for example by metalization. The grasping part 2 is hollowed to form the housing 6 to accommodate a support module 7. The support module 7 is formed from a plastic half-box containing an electronic card 14 carrying various electronic components 15 including a tactile sensor 8. The various components of the support module 7 are generally protected by a resin 16 which is poured into the half-box to encapsulate them.

The housing 6 is closed by plugging means 18 made from an insulating, sealing, weather-resistant material to isolate the support module and its electronic components from external conditions. These plugging means 18 can notably take the form of a plug or a capsule.

The tactile sensor 8 mounted in the support module 7 has a detection electrode 10 to detect a user touching action.

Figure 1:
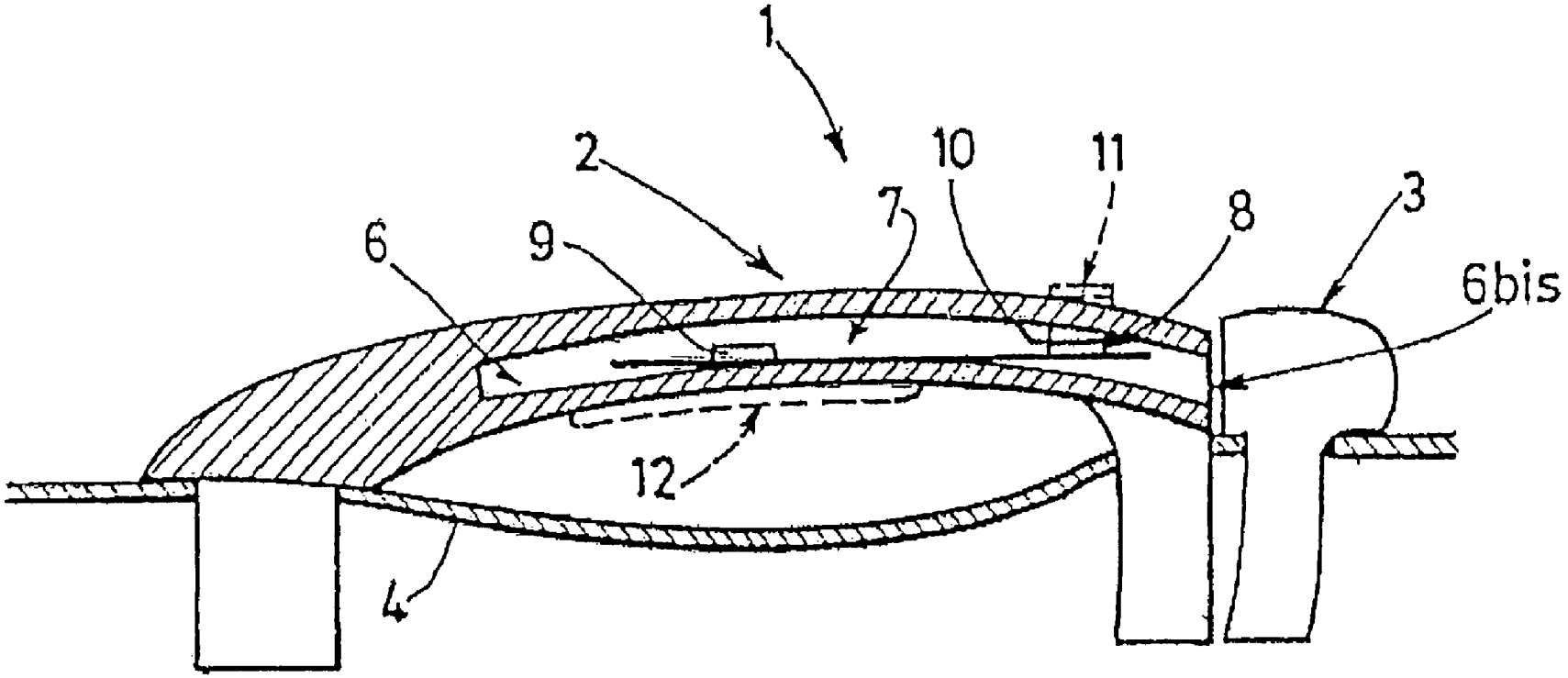
FIG.1 PRIOR ART
FIG. 1 is a sectional view of a handle of the prior art showing the location at the surface of the handle of the detection zones of the various presence sensors.
Figure 2:
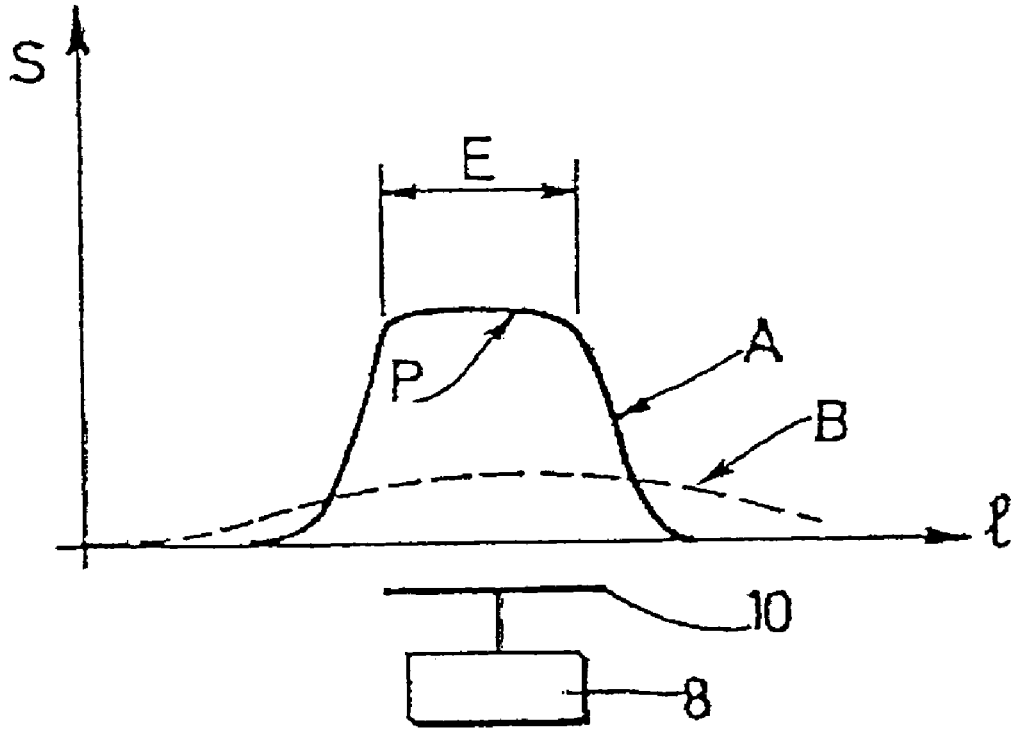
FIG.2 PRIOR ART
FIG. 2 is a schematic presentation of the detection profile of a handle tactile sensor in different conditions of use.

This handle differs from the prior art handle in FIG. 1 in that it includes conducting means used to displace the active zone of the capacitive sensor. More precisely, the first end of the conducting means takes the form of a metal blade 17 carried by the plugging means 18. The proximal end of this metal blade 17 is positioned alongside the detection electrode 10 substantially parallel to it when the plugging means are in place at the end of the housing 6.

This metal blade 17 is then connected electrically, via a capacitive coupling or electrical conduction phenomenon, to the detection electrode 10 of the tactile sensor.

Generally, this electrical connection between a detection electrode 10 of the capacitive-type presence sensor and the conducting means take different forms; this contact can be provided by:

- capacitive coupling of the sensor's detection electrode and the conducting means. The conducting means must be located near the detection electrode in order for this coupling to operate, but direct contact is not necessary. This coupling can be made for example through the protective resin encapsulating the electronic module,
- direct electrical connection by soldering, gluing, etc. between the sensor's detection electrode and the conducting means.

In the present case, the electrical connection is made by capacitive coupling of the metal blade 17 and the detection electrode 10 of the tactile sensor 8, since these two parts are not in direct contact.

This metal blade 17 of which one first end is connected electrically with the detection electrode 10 has an approximately rectangular shape such that its second end emerges at the surface of the handle.

In this manner, by a capacitive coupling and electrical conduction phenomenon between the detection electrode 10 of the tactile sensor and the metal blade 17 the detection zone of the tactile sensor is displaced to a new tactile detection zone located at the outer surface of the handle. This new detection zone, represented by dashed lines in FIG. 3, is isolated electrically from the conductive coating 5 of the grasping part 2. This electrical isolation is achieved by using an insulating material 13 notably on the inner walls of the housing 6 and on the lateral edges of the grasping part 2 opposite the non-conductive part 3 of the handle.

In a variant of this embodiment (not shown), the metal blade 17 can comprise two metal blades in electrical contact and carried by the plugging means 18.

Figure 4:
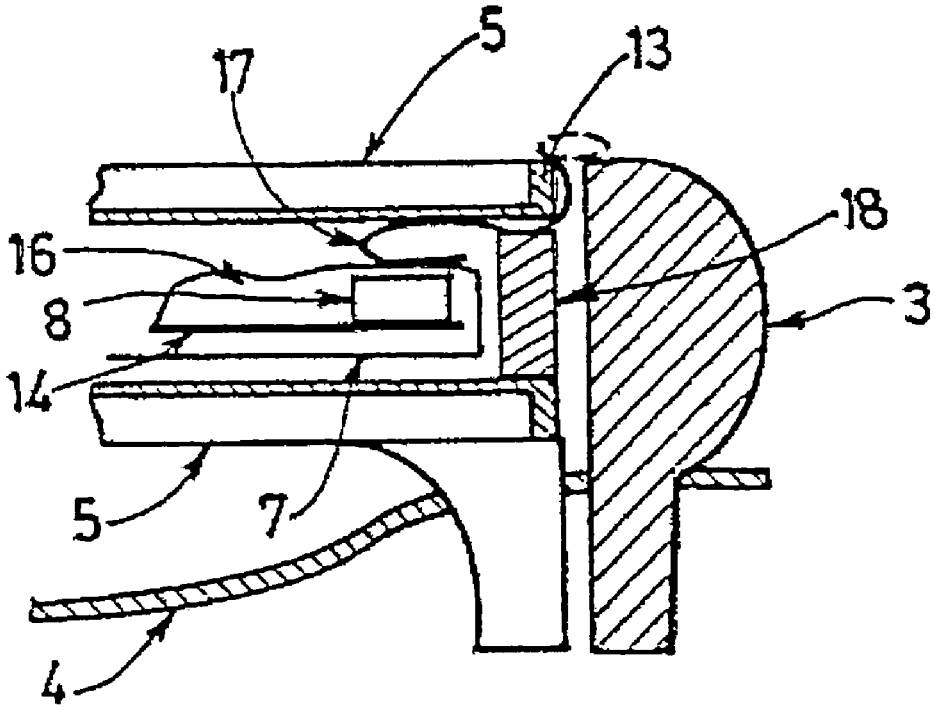
FIG. 4 is a partial sectional view of the handle including conducting means in the form of a single metal blade.

FIG. 4 shows a second embodiment in which the conducting means, in the form of a single metal blade 17, are fixed to the support module 7. The proximal end of the metal blade 17 is fixed to the support module 7 by gluing or embedding in the protective resin 16 deposited on the support module 7.

Advantageously, this metal blade 17 takes the form of a spring blade and has a second end which positions at the outer surface of the handle, by compression of the blade, when the non-conductive plugging means 18 are fitted in the end of the housing 6.

Figure 5:
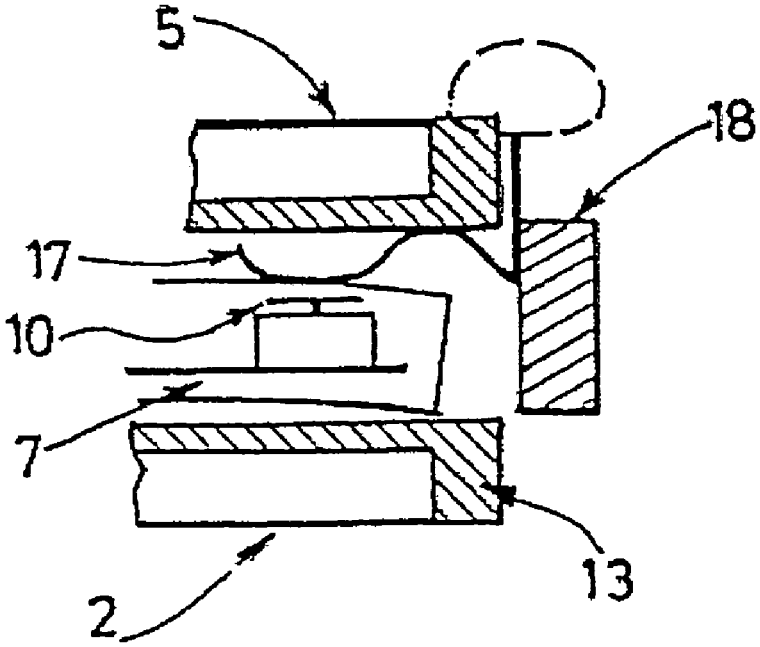
FIG. 5 is a partial sectional view of the handle in which the metal blade of the conducting means takes the form of a spring.

As also shown in FIG. 5, the metal blade 17 forming the conducting means and presented in the form of a spring also assists in positioning the support module 7 in the housing during fitting of the plugging means 18 and immobilizes the module 7 in the housing to prevent it moving later.

Figure 6:
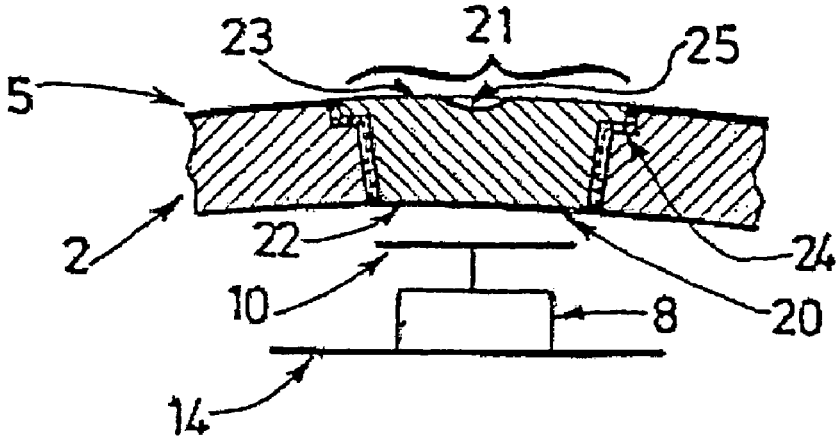
FIG. 6 is a partial sectional view of the handle in which the conducting means are fixed in an opening of the handle.

FIG. 6 shows a third embodiment of the conducting means in which they take the form of a metal insert 20.

In the grasping part 2 of the handle there is an opening 21 joining the inner housing and the outer surface of the handle.

This opening 21, which has a shoulder 24, is plugged by a metal insert of reciprocal shape. The metal insert has a first end 22 positioned close to the detection electrode 10 of the tactile sensor 8 and a second end 23 which is flush with the outer surface of the handle. This metal insert 20 provides the electrical connection between the sensor's detection electrode 10 and the outer surface of the handle.

This conductive insert can be made and fitted in the opening of the handle in various ways:

- directly during molding of the handle, by inserting a metal part during fabrication,
- by drilling the handle then fitting the metal insert.

The metal insert 20 is fixed in the opening by gluing, for example, or using fastening means such as clips. The metal insert can also be force-fitted in the opening 21 or fixed during the overmolding of the handle.

Electrical isolation of the metal insert 20 from the opening is ensured by insulating means 13 which could, for example, be incorporated in the means used to fasten the insert in the opening. Notably, the fastening glue could be electrically insulating.

The distal end 23 of the metal insert has a substantially flat surface of variable shape. This surface can notably be circular, oval or rectangular or can for example take the form of a logo representing the vehicle brand name or model.

The surface of the distal end 23 of the conductive insert 20 has a concave indent 25 approximately at its centre to identify the insert as the tactile detection zone and to ensure a more ergonomic touching action.

The electrical connection between the detection electrode 10 and the proximal end 22 of the metal insert 20 is made by capacitive coupling of these two parts. It is also possible to provide a metal blade between the detection electrode and the proximal end of the insert to make a direct conductive electrical connection.

Figure 7A:
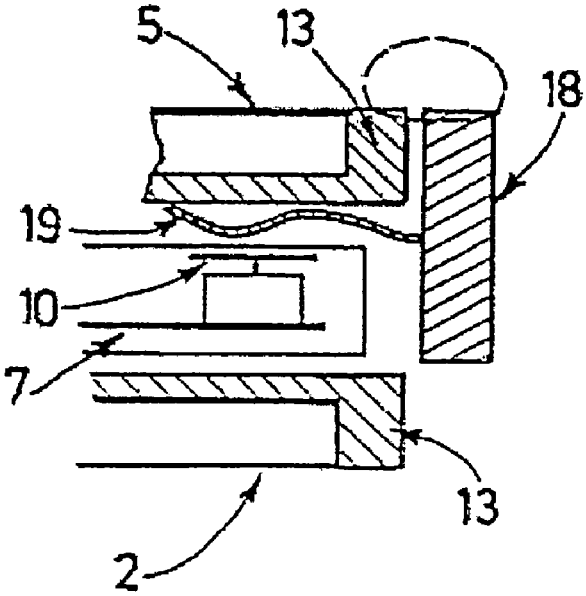
FIGS. 7*a* and 7*b* are two sectional views of a same handle including conducting means in the form of plugging means.
Figure 7B:
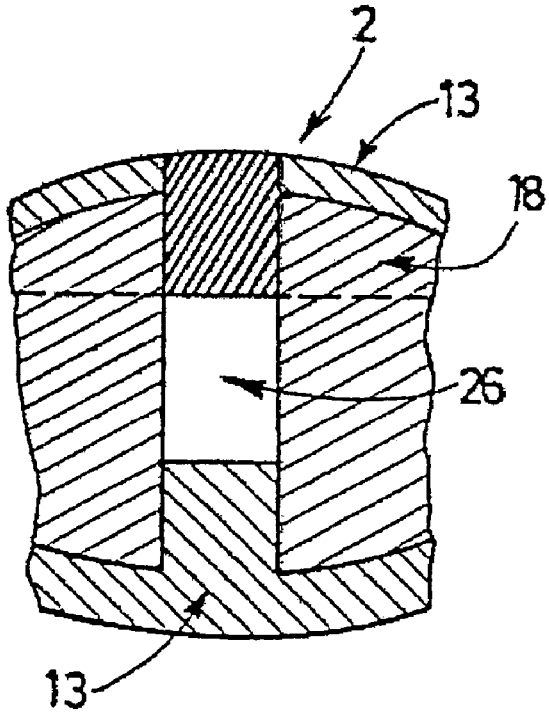

FIGS. 7*a*, 7*b* show two different sections revealing detail of an additional embodiment of the conducting means.

In this embodiment, the plugging means 18 of the housing 6 in the grasping part 2 is made from electrically conductive material.

The plugging means 18 take the form, for example, of a substantially circular or square plug or capsule. A tongue is cut from the surface of these plugging means; it is held at the centre of and projects from one side of the plugging means. This tongue is bent along an axis substantially perpendicular to the longitudinal axis of the grasping part 2 of the handle towards the interior of the housing 6. It forms a metal blade 19 which, after fitting the plugging means 18 in the opening of housing 6, provides the coupling with the detection electrode 10 of the sensor 8.

As seen in FIG. 7*b*, the metal blade 19 is formed directly from the plugging means 18 by cutting a tongue then bending it along an axis substantially perpendicular to the longitudinal axis of the grasping part 2 of the handle. The opening 26 that appears when bending the tongue is then plugged by a sealing part to protect the electronic module from weather. In this embodiment, the plugging means 18 have an end at the surface of the handle to create a new detection zone.

The metal blade 19 is part of and is cut directly from the plugging means 18. These plugging means 18 therefore enable, with a single part, to make an electrical connection by capacitive coupling of the detection electrode 10 of the tactile sensor and the surface of the handle. As shown schematically in FIG. 7*a*, the new tactile detection zone is isolated from the conductive surface 5 of the grasping part by insulating means 13 and is located at the surface of the handle at the position where the plugging means 18 emerge. The insulating means 13 are formed from insulating material positioned on the inner walls and external edges of the housing 6.

The plugging means 18 therefore constitute an intermediate part of the conducting means.

Figure 8:
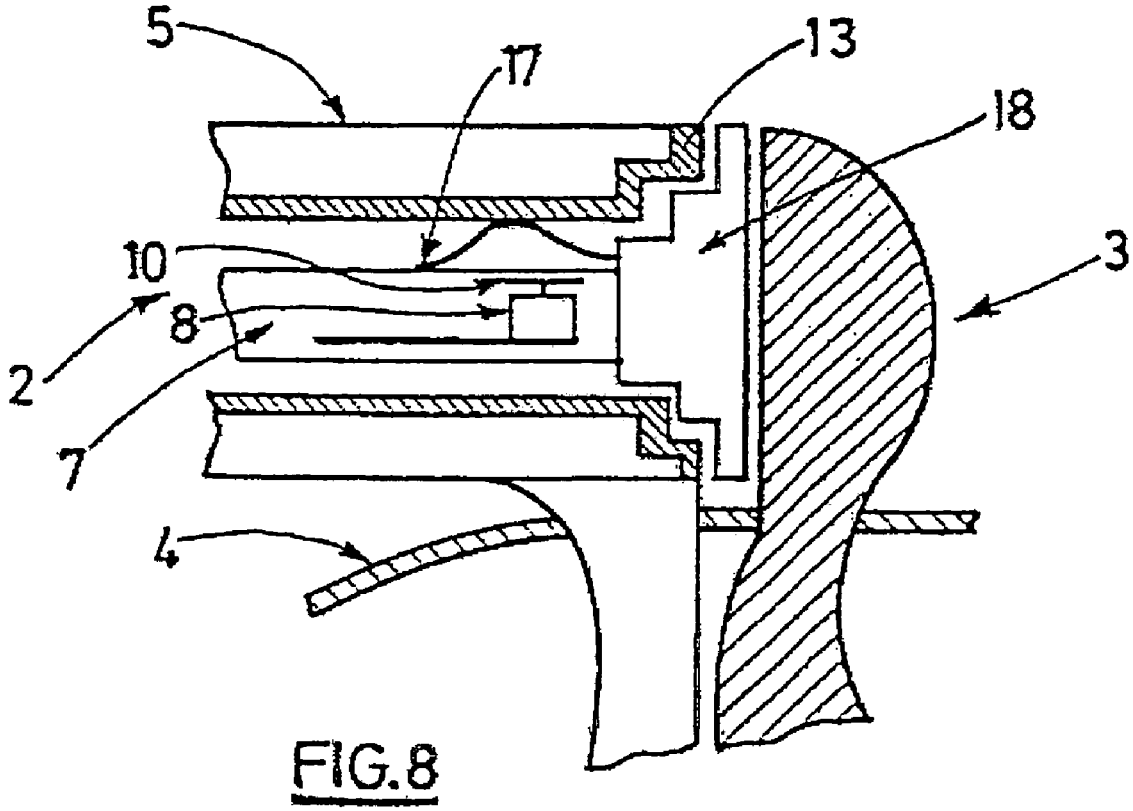
FIG. 8 is a partial sectional view of the handle in which the metal blade is fixed on the plugging means.

FIG. 8 shows a fifth embodiment of the conducting means.

In this embodiment, the support module 7 has, at its end where the housing 6 is open, conductive plugging means 18 on which are fixed a metal blade 17. The metal blade 17 forms the proximal end of the conducting means and the plugging means 18 form the distal end of the conducting means, the whole assembly being directly attached to the support module 7. Consequently, the conducting means are an integral part of the support module 7.

Figure 9:
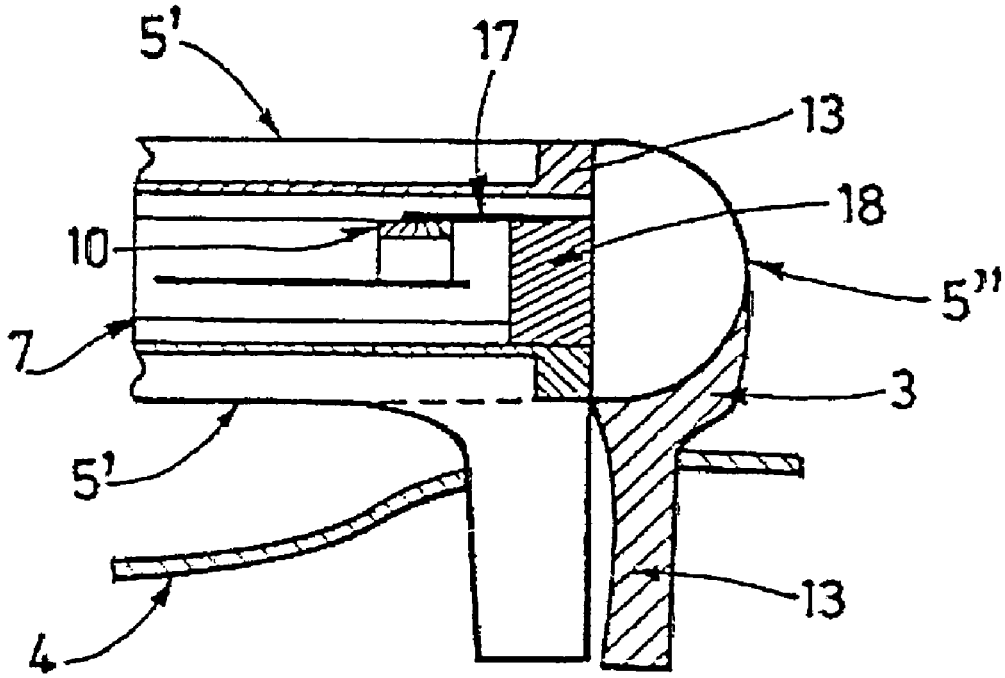
FIG. 9 is a partial sectional view of the handle in which the distal end of the conducting means form a conductive part of a fixed part of the handle.

FIG. 9 shows another embodiment of the conducting means.

In this embodiment, the part 3 of the handle fixed relative to the vehicle door is partially conductive or has a conductive coating 5" on part of its surface. This conductive surface 5" represents the new tactile detection zone. The detection electrode 10 of the tactile sensor 8 is displaced by capacitive coupling and electrical conduction to the position of the conductive part 5" of the fixed part 3 via a metal blade 17 and conductive plugging means 18. The plugging means 18 are positioned opposite the fixed part 3 and are in contact with it when the handle is in rest position. In this manner, a new tactile detection zone is created on the conductive surface of the fixed part. This arrangement takes account of the fact that detection of a touching action is required only for a locking command, the handle then being in rest position.

This electrical conduction from the detection electrode 10 of the tactile sensor to the new tactile detection zone is isolated from the conductive surface 5' of the grasping part 2 of the handle by inserting insulating material 13 on the inner walls and the edges of the lateral opening of the housing 6.

In this embodiment, part 3 of the handle is fixed relative to the door, but this fixed part could be fitted with a movable conductive part, in which case this movable conductive part serves as a new tactile detection zone and can notably take the form of a lock cache.

Figure 10:
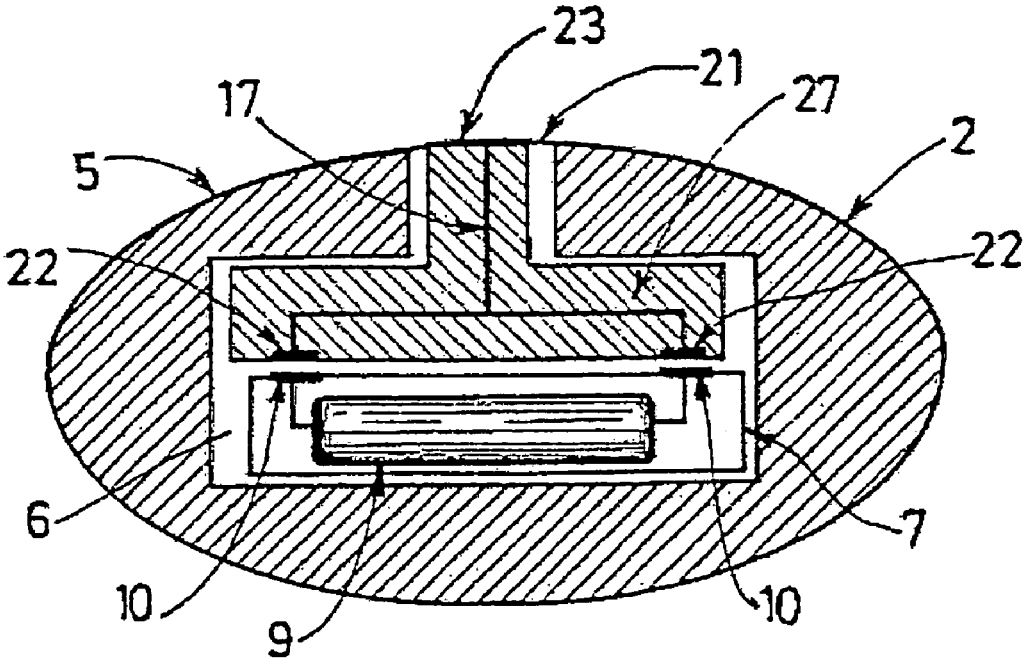
FIG. 10 is a sectional view, along the Y axis of FIG. 1, of the grasping part of the handle at the position of the approach sensor in which the conducting means have a number of distal ends.

FIG. 10 shows another embodiment of invention in which the presence sensor is an approach sensor 9.

The grasping part 2 has a housing 6 containing a support module 7 that includes an approach sensor 9 with two electrodes 10.

The housing 6 also contains a part 27 made from insulating material overmolding conducting means in the form of a metal blade 17. This metal blade has two proximal ends 22 positioned close to the two electrodes 10. The blade 17 also has a distal end 23 positioned in an opening 21 penetrating the outer surface of the handle. In this manner the distal end 23 of the conducting means is flush with the outer surface of the handle.

Generalizing this arrangement, the sensor can have any number of electrodes 10 and the conducting means is formed with the same number of metal blades each including a proximal end positioned close to an electrode and a distal end emerging at the outer surface of the handle via openings.

When necessary, or in order to substantially improve the size and sensitivity of the approach detection zone, several devices like the one in FIG. 10 can be incorporated in a single handle.

Figure 11:
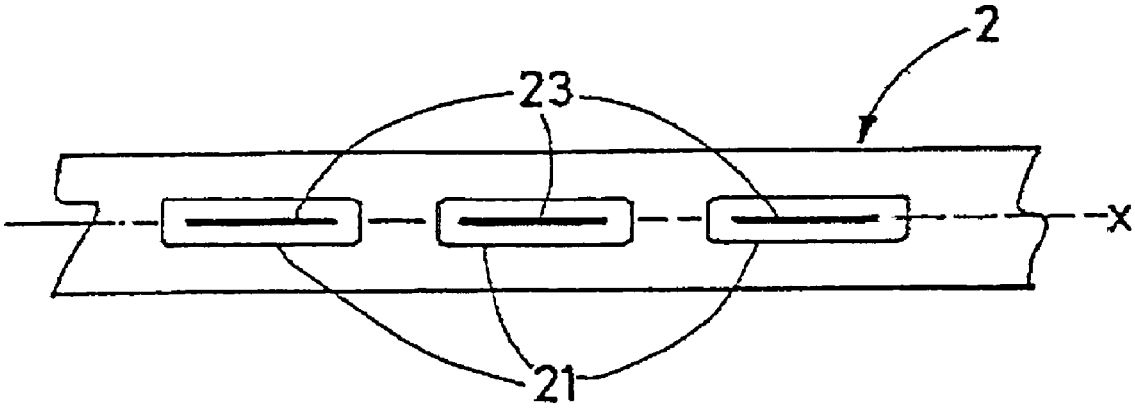
FIG. 11 is a partial view of the grasping part of the handle with a number of openings.

This idea is schematized in FIG. 11 which represents the section of the grasping part 2 of the handle facing the door 4.

This section has a number of openings 21 aligned parallel to a longitudinal X axis of the grasping part 2 of the handle. For each opening 21 there is a distal end 23 flush with the outer surface of the handle. For each of these distal ends 23 there are conducting means 17 associated each with at least one detection electrode 10.

All the embodiments of conducting means used to create a new presence detection zone of a user at the handle have been described for the case of a so-called "refrigerator-type" handle, but they are quite transposable to the case of the so-called "pallet-type" handle.

The shapes of the metal blades and plugging means are in no way limitative, since other shapes or embodiments of these blades and plugging means can easily be envisaged.

The metal blade 17 has been shown in the form of a single blade, but it would be possible to make it in the form of two blades, a first blade fixed to the electronic module, for example, and a second blade attached for example to the plugging means of which one end is at the surface of the handle to establish electrical continuity with the sensor's detection electrode. As in the embodiments described above, this new detection zone is isolated from the initial tactile detection zone and possibly from the conductive surface of the grasping part of the handle.

Similarly, it is quite possible to ensure electrical continuity between a detection electrode of the presence sensor—whether it be an approach sensor or a tactile sensor—and the surface of the handle using other means or by a combination of the means described.

What is claimed is:

1. Door handle (1), in particular for a motor vehicle, comprising at least one presence sensor (8, 9) having at least one electrode, (10) for detecting the presence of a user at said handle, wherein it comprises conducting means (17, 18, 3) having at least one proximal end (22) directly or indirectly connected by capacitive coupling to said detection electrode and at least one distal end (23) emerging in electrical insulation on the outer surface of the handle so as to create at least one new zone for detecting the presence of a user.

2. Door handle according to claim 1, wherein it has a grasping part (2) with an inner housing (6), formed by an elongated cavity in this grasping part, which houses said presence sensor (8, 9).

3. Door handle according to claim 1, wherein said presence sensor has at least two electrodes (10) and wherein for each electrode said conducting means (17, 18, 3) have an associated proximal end (22) positioned near this electrode.

4. Door handle according to claim 3, wherein said proximal end (22) of said conducting means is formed by a metal blade (17) positioned near said electrode (10) and of which at least one part is approximately parallel to it.

5. Door handle according to claim 4, wherein said conducting means are formed by a single metal blade (17).

6. Door handle according to claim 3, wherein said presence sensor (8, 9) is carried by a support module (7) inserted in said housing (6) and wherein said metal blade (17) takes the form of a spring positioning and/or holding said support module (7) in said housing (6).

7. Door handle according to claim 6, wherein said metal blade (17) is fixed on said support module (7) or on said presence sensor (8, 9).

8. Door handle according to claim 1, wherein it also comprises at least one opening (21) emerging at the outer surface of the handle and wherein said distal end (23) of said conducting means is flush with this outer surface.

9. Door handle according to claim 8, wherein said conducting means have a number of distal ends (23) flush with the outer surface of the handle at the positions of the associated openings (21).

10. Door handle according to claim 9, wherein said openings (21) are aligned parallel to a longitudinal axis of said grasping part (2) of the handle.

11. Door handle according to claim 8, wherein said conducting means (17, 18, 3) are held in said opening (21) by fastening means that also serve as electrical insulator.

12. Door handle according to claim 11, wherein said fastening means are formed by a glue or clipping means of plastic material.

13. Door handle according to claim 8, wherein said conducting means are overmoulded in an insulating material.

14. Door handle according to claim 13, wherein said insulating material overmolding said conducting means form plugging means for said openings.

15. Door handle according to claim 1, wherein said conducting means (17,3) have an intermediate part constituted by means (18) of plugging said housing (6) of said presence sensor (8, 9).

16. Door handle according to claim 5 taken together with claim 15, wherein said metal blade (17, 19) is fixed to and/or formed from the material of said plugging means (18).

17. Door handle according to claim 1, wherein said distal end (23) of said conducting means includes a movable part.

18. Door handle according to claim 17, wherein said movable part is a lock cache, notably of a backup lock.

19. Door handle according to claim 17, wherein said distal end forms a conductive part of a handle part (3) fixed relative to the door and wherein said presence sensor is housed in a mobile grasping part of the handle.

20. Door handle according to claim 1, wherein it is made of a plastic material.

21. Door handle according to claim 20, wherein its outer surface is covered with a conductive coating (5).

22. Door handle according to claim 21, wherein said conducting means have a conductivity higher than that of said conductive coating of the handle.

23. Door handle according to claim 21, wherein said conductive coating (5) is a metalized paint or a direct metalization.

24. Door handle according to claim 1, wherein the handle is made of metal and wherein it also includes electrical insulation means forming a sheath for said conducting means.

25. Door handle according to claim 1, wherein said presence sensor is an approach sensor (9) to detect the approach of a user near the handle.

26. Door handle according to claim 1, wherein said presence sensor is a tactile sensor (8) to detect a user touching the handle.

27. Door handle according to claim 26, wherein said new detection zone of the tactile sensor is delimited by the shape of said distal end (23) of said conducting means (17, 18, 3).

28. Door handle according to claim 1, wherein said presence sensor is of capacitive type.

29. Hands-free access system for a motor vehicle comprising at least one door handle according to claim 1.

* * * * *